United States Patent [19]

Vogt, Jr. et al.

[11] Patent Number: 4,869,322

[45] Date of Patent: Sep. 26, 1989

[54] SEQUENTIAL HYDRAULIC FRACTURING OF A SUBSURFACE FORMATION

[75] Inventors: Thomas C. Vogt, Jr., Littleton, Colo.; Mitchell W. Hale, Seal Beach; Jay R. Sellers, Bakersfield, both of Calif.

[73] Assignee: Mobil Oil Corporation, New York, N.Y.

[21] Appl. No.: 254,560

[22] Filed: Oct. 7, 1988

[51] Int. Cl.[4] ..... E21B 43/267

[52] U.S. Cl. ..... 166/280; 166/308

[58] Field of Search ..... 166/250, 271, 280, 308

[56] References Cited

U.S. PATENT DOCUMENTS

| | | | |
|---|---|---|---|
| 3,965,982 | 6/1976 | Medlin | 166/249 |
| 3,987,850 | 10/1976 | Fitch | 166/254 |
| 4,005,750 | 2/1977 | Shuck | 166/308 |
| 4,067,389 | 1/1978 | Savins | 166/308 X |
| 4,378,845 | 4/1983 | Melin et al. | 166/297 |
| 4,515,214 | 5/1985 | Fitch et al. | 166/250 |
| 4,549,608 | 10/1985 | Stowe et al. | 166/280 |
| 4,687,061 | 8/1987 | Uhri | 166/308 |
| 4,714,115 | 12/1987 | Uhri | 166/308 |
| 4,724,905 | 2/1988 | Uhri | 166/308 X |

*Primary Examiner*—George A. Suchfield

*Attorney, Agent, or Firm*—Alexander J. McKillop; Charles J. Speciale; George W. Hager, Jr.

[57] ABSTRACT

A subsurface formation having original in-situ stresses that favor the propagation of a horizontal fracture is penetrated by a borehole. A first fracturing fluid containing a propping material is pumped through the borehole and into the formation at a first depth to propagate a horizontal fracture which alters the in-situ stress field. The pumping of the first fracturing fluid is stopped and a second fracturing fluid is pumped through the borehole and into the formation at a second depth to form a vertical fracture within the field of altered in-situ stress.

2 Claims, 3 Drawing Sheets

SEQUENTIAL HYDRAULIC FRACTURING OF A SUBSURFACE FORMATION

BACKGROUND OF THE INVENTION

This invention relates to the sequential hydraulic fracturing of subterranean formations and more particularly to the forming of a vertical hydraulic fracture in a subterranean formation that is normally disposed to form a horizontal hydraulic fracture.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is applied to the fracturing fluid to initiate and propagate a fracture into the subterranean formation. Proppant materials are generally entrained in the fracturing fluid and are deposited in the fracture to maintain the fracture open.

Several such hydraulic fracturing methods are disclosed in U.S. Pat. Nos. 3,965,982; 4,067,389; 4,378,845; 4,515,214; and 4,549,608 for example. It is generally accepted that the in-situ stresses in the formation at the time of such hydraulic fracturing generally favor the formation of vertical fractures in preference to horizontal fractures at depths greater than about 2000 to 3000 ft. while at shallower depths such in-situ stresses can favor the formation of horizontal fractures in preference to vertical fractures.

For oil or gas reservoirs found at such shallow depths, significant oil or gas production stimulation could be realized if such reservoir were vertically fractured. For example, steam stimulation of certain heavy oil sands would be enhanced and productivity would be optimized in highly stratified reservoirs with low vertical permeability. Creation of such vertical fractures has been disclosed in U.S. Pat. Nos. 4,687,061 and 4,714,115 to Duane C. Uhri. Both these patents disclose sequential hydraulic fracturing techniques for forming the vertical fracture. In U.S. Pat. No. 4,687,061, a subsurface formation surrounding a deviated borehole and having original in-situ stresses that favor the propagation of a vertical fracture is penetrated by a cased borehole. The casing is perforated at a pair of spaced-apart intervals to form a pair of sets of perforations. Fracturing fluid is initially pumped down said cased borehole and out one of said sets of perforations to form a first fracture that is oriented in a direction perpendicular to the direction of the least principal in-situ horizontal stress. The propagation of this first vertical fracture changes the in-situ stresses so as to favor the propagation of a second vertical fracture. This is oriented in a direction perpendicular to the direction of the altered local least principal in-situ horizontal stress. Thereafter, while maintaining pressure in the first vertical fracture, fracturing fluid is pumped down said cased borehole and out of the other of said sets of perforations to form such a second vertical fracture which will now link naturally occurring fractures in the formation to the deviated wellbore.

In U.S. Pat. No. 4,714,115 a subsurface formation having original in-situ stresses that favor the propagation of a horizontal fracture is penetrated by a cased borehole which is perforated at a pair of spaced-apart intervals to form a pair of sets of perforations. Fracturing fluid is initially pumped down said cased borehole and out one of said sets of perforations to form the originally favored horizontal fracture. The propagation of this horizontal fracture changes the in-situ stresses so as to favor the propagation of a vertical fracture. Thereafter, while maintaining pressure on said horizontal fracture, fracturing fluid is pumped down said cased borehole and out of the other of said sets of perforations to form the newly favored vertical fracture.

SUMMARY OF THE INVENTION

In accordance with the present invention at least one vertical hydraulic fracture is propagated in an earth formation surrounding a borehole wherein the original in-situ stress field favors a horizontal fracture. A first fracturing fluid containing a propping material is pumped into the earth formation at a first depth to propagate a horizontal fracture. The propagation of such horizontal fracture alters the in-situ stress field within the formations surrounding the horizontal fracture. Upon completion of the horizontal fracture, the fracturing pressure is removed from the formation by stopping the pumping of the first fracturing fluid. A second fracturing fluid is then pumped into the formation at a second depth within the field of altered in-situ stress to propagate a vertical fracture within the field of altered in-situ stress which is being maintained during the vertical fracturing operation by the presence of the propping material deposited in the horizontal fracturing during the horizontal fracturing operation. In similar manner, additional vertical fractures may be propagated in the formation within the field of altered in-situ stress.

DESCRIPTION OF THE PREFERRED EMBODIMENT

Figure 1:
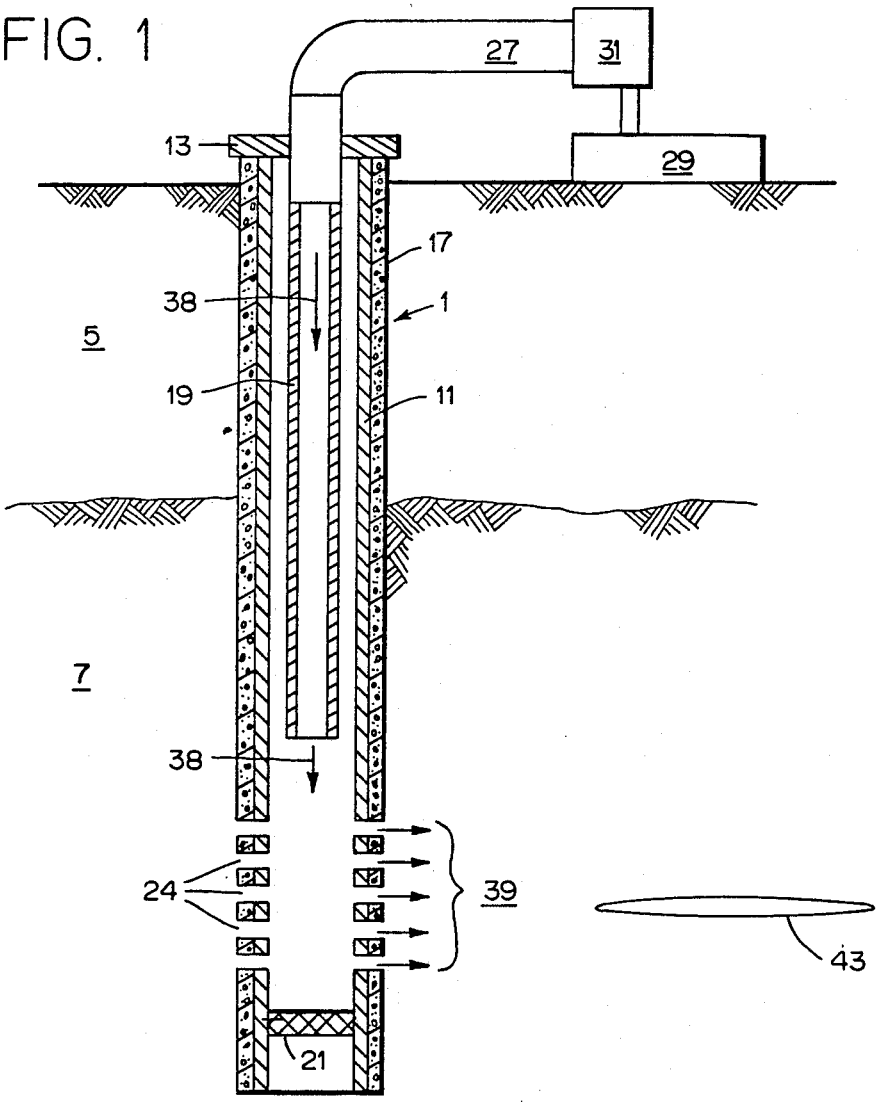
FIG. 1 and FIG. 2 illustrate a borehole apparatus penetrating an earth formation to be hydraulically fractured in accordance with the present invention.

Referring now to FIG. 1 there is shown formation fracturing apparatus within which the sequential hydraulic fracturing method of the present invention may be carried out. A wellbore 1 extends from the surface 3 through an overburden 5 to a productive formation 7 where the in-situ stresses favor a horizontal fracture. Casing 11 is set in the wellbore and extends from a casing head 13 to the productive formation 7. The casing 11 is held in the wellbore by a cement sheath 17 that is formed between the casing 11 and the wellbore 1. The casing 11 and cement sheath 17 are perforated at 24 where the local in-situ stresses favor the propagation of a horizontal fracture. A tubing string 19 is positioned in the wellbore and extends from the casing head 13 to the lower end of the wellbore above the perforations 24. A bridge plug 21 is placed in the wellbore below the perforations 24. The upper end of tubing 19 is connected by a conduit 27 to a source 29 of fracturing fluid and proppant. A pump 31 is provided in communication with the conduit 27 for pumping the fracturing fluid and proppant from the source 29 down the tubing 19.

Figure 2:
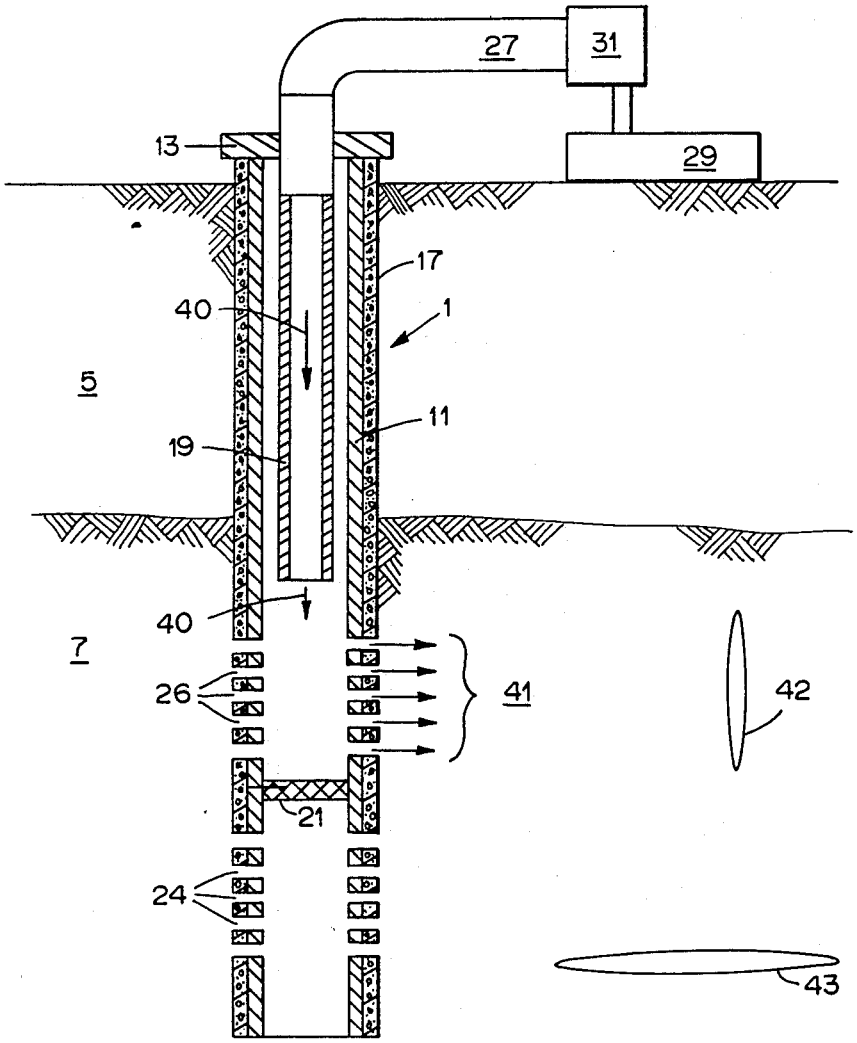
Figure 3:
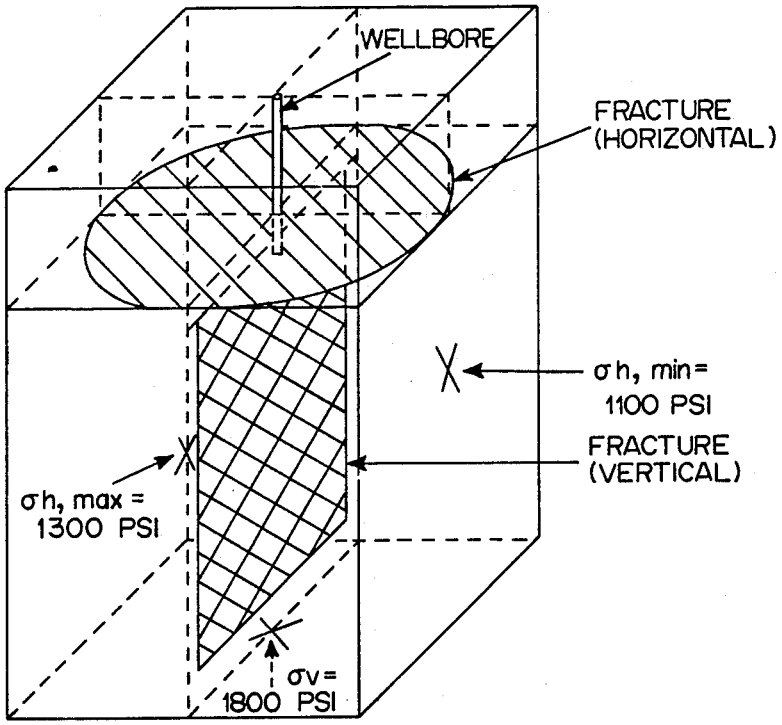
FIG. 3 is a pictorial representation of hydraulic fractures, formed in the earth formation by use of the apparatus of FIG. 1 and FIG. 2.

In carrying out the sequential hydraulic fracturing method of the present invention with the apparatus of FIG. 1 in a zone of the formation where the in-situ stresses favor a horizontal fracture, such a horizontal fracture 43 is initially propagated, preferably in the lower portion of productive zone 7, by activating the pump 31 to force fracturing fluid out the bottom of tubing 19 as shown by arrows 38 and through the perforations 24 into the production zone 7 as shown by arrows 39 at a point near the bottom of the production zone 7. The fact that this will be a horizontal fracture in certain formations can best be seen by reference to FIG. 3 where three orthogonal principle original in-situ stresses are operative. While a horizontal fracture is shown above a vertical fracture in FIG. 3, this is merely by way of illustration and the horizontal fracture may preferably be below the vertical fracture as depicted in FIG. 1 and FIG. 2. After the horizontal fracture has been emplaced, the altered local modified in-situ stresses are a vertical stress ($\sigma_v$) of 1800 psi for example, a minimum horizontal stress ($\sigma_h/\sigma_v$min) of 1100 psi for example, and a maximum horizontal stress ($\sigma_h$max) of 1300 psi for example.

The mean horizontal stress ($\sigma_h$) is, therefore 1200 psi. This results in a ratio of mean horizontal stress to vertical stress ($\sigma_h/\sigma_v$) of 0.667. Using this value and the equations set forth in "Introduction to Rock Mechanics" by R. E. Goodman, John Wiley and Sons, N.Y., 1980, pps. 111–115, a vertical stress of greater than 2000 psi is required for a vertical fracture to form. Typical ranges of $\sigma_h/\sigma_v$ are 0.5 to 0.8 for hard rock and 0.8 to 1.0 for soft rock such as shale or salt. For the foregoing example, a fluid pressure of 1900 psi is maintained during the initial propagation of a horizontal fracture 43 by controlling the fracturing fluid flow rate through tubing 19 or by using well known gelling agents.

Referring now to FIG. 2, due to the pressure in the horizontal fracture 43, the local in-situ stresses in the production zone 7 are now altered from the original stresses to favor the formation of a vertical fracture 42. The bridge plug 21 is moved to a position above perforations 24. The casing 11 and cement sheath 17 are perforated at 26 where the in-situ stresses are now altered. Such a vertical fracture 42 can thereafter be formed in production zone 7 by activating the pump 31 to force fracturing fluid down the tubing 20 as shown by arrows 40 through the performations 26 into the formation as shown by arrows 41 at a point immediately above the bridge plug 21.

As discussed above in reference to U.S. Pat. No. 4,714,115, such a sequential hydraulic fracturing technique is carried out by maintaining the pressure on the horizontal fracture while the vertical fracture is being formed. After the vertical fracture is formed the pressure maintenance on the horizontal fracture may be removed. Such pressure maintenance is required to maintain the altered in-situ stress necessary for the creation of the vertical fracturing. While the vertical fracture is created sequentially following the horizontal fracture, i.e. sequential hydraulic fracturing, the two fracturing operations are carried out simultaneously in that the horizontal fracturing operation is not terminated until the vertical fracturing operation is completed.

In contrast to the teaching of U.S. Pat. No. 4,714,115, the present invention provides for a true sequential hydraulic fracturing operation in which the horizontal fracturing operation is completed before the initiation of the vertical fracturing operation. More particularly, the present invention is a sequential hydraulic fracturing operation in which no pressure maintenance is required on the horizontal fracture for the vertical fracture to be propagated. In accordance with the present invention, the altered in-situ formation stress created by the horizontal fracture can be maintained without pressure maintenance. More particularly, the horizontal fracture is formed by the injection of a fracturing fluid into the formation over a first time interval containing a propping material to be deposited in the fracture to form a propped horizontal fracture. Such use of a propping material is described in U.S. Pat. No. 3,987,850 to J. L. Fitch. However, the present invention recognizes that the propped condition of the horizontal fracture will maintain the field of altered in-situ stress so as to favor the creation of a subsequent vertical fracture just as the pressure maintenance did in the teaching of U.S. Pat. No. 4,714,115.

Consequently, the vertical fracture may be created by a subsequent fracturing operation over a second time interval that is not initiated until some time, even days, after the completion of the horizontal fracturing operation and the removal of the fracturing fluid pressure within such horizontal fracture. The vertical fracture may be thereafter propagated so long as there is the necessary amount of propping material in the horizontal fracture to prevent relaxation of the altered in-situ stress field in that part of the production zone where the vertical fracture is to be created.

In one successful hydraulic fracturing operation carried out in accordance with the present invention, the horizontal fracture was propagated through the pumping of 2887 barrels of 40 lb of gel per 1000 gal fracturing fluid at a rate of 2.5 barrels per minute containing 268 pounds of 20/40 mesh sand proppant. The vertical fracture was subsequently propagated through the pumping of 4012 barrels of 40 lb gel per 1000 gal fracturing fluid at a rate of 2.5 barrels per minute containing 402,000 pounds of 20/40 mesh sand as proppant. The presence of horizontal and vertical fractures was confirmed using tiltmeters on the surface and from analysis of radioactive tracer logs that inferred the geometry of the fracture by detecting tracer added to the proppant during the well treatment.

Two wells treated in the manner just described reached a cumulative production of from 7 to 10 thousand barrels of oil after 130 days compared to two offset wells that had been fractured in a more conventional manner about five years ago and had produced only 6 thousand barrels of oil during that time. In three other instances the initial production rate of wells fractured according to the method of this invention had initial production rates twice that of those that were treated in a conventional manner resulting in a horizontal fracture(s) in the productive interval., Instead of forming the horizontal fracture below, the vertical fracture 42 as described above as shown in FIG.

1, the fracturing fluid could be firstly pumped down annulus 20 and out perforations 24 to form the horizontal fracture higher in the production zone 7 and thereafter pumping the fracturing fluid down the tubing 19 and out perforations 26 to form the vertical fracture near the bottom of the production zone 7.

Having now described a preferred embodiment for the method of the present invention, it will be apparent to those skilled in the art of hydraulic fracturing that various changes and modifications may be made without departing from the spirit and scope of the invention as set forth in the appended claims. For example, instead of forming the vertical fracture above the horizontal fracture as described above and shown in FIG. 2, the vertical fracture could be formed below the horizontal fracture by firstly pumping fracturing fluid into an upper portion of the production zone where the original stresses favor a horizontal fracture and thereafter pumping fracturing fluid into a lower portion of the production zone where the original stresses have now been altered to favor a vertical fracture. Further, an additional vertical fracture could be formed in the production zone by thereafter pumping fracturing fluid into a third portion of the production zone where the original stresses have also been altered to favor a vertical fracture. This additional vertical fracture could be above or below the horizontal fracture and/or the initial vertical fracture. Any such changes and modifications coming within the scope of such appended claims are intended to be included herein.

We claim:

1. A method for propagating a vertical hydraulic fracture in an earth formation surrounding a borehole wherein the original in-situ stresses favor a horizontal fracture, comprising the steps of:

(a) pumping a first fracturing fluid into said formation at a first depth within said borehole so that a first fracturing pressure is applied to said formation by said first fracturing fluid to propagate a horizontal fracture as favored by the original in-situ stresses of the formation, the propagation of said horizontal fracture altering the original in-situ stresses in the formation, (b) injecting a propping material into said horizontal fracture while maintaining said first fracturing pressure in said horizontal fracture in sufficient amount to prevent relaxation of said altered in-situ stresses in said formation after the pumping of said first fracturing fluid is terminated and said first fracturing pressure is removed, (c) terminating the pumping of said first fracturing fluid into said horizontal fracture to remove said first fracturing pressure from said formation, (d) pumping a second fracturing into said formation at a second depth within said borehole within the field of said altered in-situ stresses so that a second fracturing pressure is applied to said formation by said second fracturing fluid to propagate a vertical fracture in said formation as favored by said altered in-situ stresses so long as the presence of said propping material in said horizontal fracture prevents relaxation of said altered in-situ stresses, and (e) terminating the pumping of said second fracturing fluid to said vertical fracture to remove said second fracturing pressure from said formation.

2. The method of claim 1 further comprising the steps of:

(a) pumping a third fracturing fluid into said formation at a third depth within said borehole within the field of altered in-situ stresses so that a third fracturing pressure is applied to said formation by said third fracturing fluid to propagate an additional vertical fracture in said formation as favored by said altered in-situ stresses so long as the presence of said propping material in said horizontal fracture prevents relaxation of said altered in-situ stresses, and (b) terminating the pumping of said third fracturing fluid to said additional vertical fracture to remove said third fracturing pressure from said formation.

* * * * *